United States Patent [19]

Fontana et al.

[11] Patent Number: 4,790,453

[45] Date of Patent: Dec. 13, 1988

[54] PLASTIC CONTAINER FOR THE CONTROLLED DISPENSING OF POWDERS AND/OR LIQUIDS

[75] Inventors: Antonio Fontana; Giovanni Ferrari, both of Carpi; Evro Fabbri, Rovereto di Novi; Romano Campanini, Siena, all of Italy

[73] Assignees: Lameplast di Giovanni Ferrari & C. s.n.c., Modena; Sclavo S.p.A., Siena, both of Italy

[21] Appl. No.: 947,893

[22] Filed: Dec. 30, 1986

[30] Foreign Application Priority Data

Dec. 31, 1985 [IT] Italy ..... 29063/85[U]

[51] Int. Cl.[4] ..... B67B 7/24

[52] U.S. Cl. ..... 222/83; 222/91; 222/129; 222/541

[58] Field of Search ..... 222/83, 81, 83.5, 88, 222/89, 91, 129, 541; 206/634; 215/250, 257

[56] References Cited

U.S. PATENT DOCUMENTS

| | | | |
|---|---|---|---|
| 2,771,218 | 11/1956 | Henderson | 222/541 |
| 3,109,562 | 11/1963 | Ferris | 222/81 |
| 3,223,298 | 12/1965 | Roberson et al. | 222/541 |
| 3,917,120 | 11/1975 | Larenz et al. | 222/541 |
| 4,512,475 | 4/1985 | Federighi | 222/541 |

FOREIGN PATENT DOCUMENTS

| | | | |
|---|---|---|---|
| 1041414 | 10/1958 | Fed. Rep. of Germany | 222/81 |
| 2921528 | 12/1980 | Fed. Rep. of Germany | 222/83 |
| 3100048 | 8/1982 | Fed. Rep. of Germany | 222/81 |
| 84196 | 10/1964 | France | 222/81 |
| 576376 | 6/1976 | Switzerland | 215/250 |

*Primary Examiner*—H. Grant Skaggs

*Attorney, Agent, or Firm*—Birch, Stewart, Kolasch & Birch

[57] ABSTRACT

A container provided for the controlled dispensing of powders and liquids which compress, a container body, an extremely threaded neck provided on said container body, a cylindrical, tubular extension member axially connected at one end to the externally threaded container neck, the cylindrical, tubular extension member having an inner base compressing a calibrated portion and terminating at the other end thereof in a divergent frustoconical outlet mouth portion, a rupturable transverse membrane diaphragm scalingly separating the calibrated portion from the outlet mouth portion, a circumferential groove provided on the outer surface of said tubular extension member, in the vicinity of the diaphragm, a cylindrical capsule acting as a scaling and rescaling device, the capsule having at one end thereof an internally threaded portion adapted for screw engagement with the externally threaded neck, and an elastic training ring circumferentially provided on the inner surface of the cylindrical capsule for spring-engagement with said circumferential groove, whereby when the restraining ring is engaged on said circumferential groove, the axial movement of the cylindrical capsule relative to the extremely threaded neck is prevented.

3 Claims, 1 Drawing Sheet

PLASTIC CONTAINER FOR THE CONTROLLED DISPENSING OF POWDERS AND/OR LIQUIDS

BACKGROUND AND SUMMARY OF THE INVENTION

The present invention relates to a plastic container for the controlled delivery powders and of liquids as drops, and provided with a piercing closure capsule which is actuatable at the time of use. Thus, a vial made from a flexible plastic material is equipped with a capsule provided with a piercing element, which allows the opening to be accomplished. The device is particularly suitable for the dispensing of liquids, for example, the dropwise administration, of pharmaceuticals or powders.

The state of the art comprises vials of plastic material or glass, provided with a stem dropper, which must be inserted or screwed down to allow the liquid contained in the vials to be delivered. Furthermore, plastic vials are known, the outlet mouth of which can be activated by the tearing of a shutter provided with a grip tab actuatable by torsion. However, the stem dropper is not hygienic, is expensive and involves auxiliary operations. On the other hand, the tearable dropper does not result in a hygienic operation as related to the re-use of the shutter, and, furthermore, it does not provide a calibrated flow of drops, particularly because of the fringes generated by the tearing of the outlet orifice.

Thus the state of the art can be improved as it relates to the possibility of overcoming the above-indicated drawbacks.

From the above, there has been identified a need for solving the technical problem of providing a device for a plastic vial which allows the outlet mouth of the vial to be closed and controlled for achieving a hygienic seal and permits a delivery of the liquid contents as uniform drops and that in a manner which is simple, convenient and inexpensive.

The present invention solves the above technical problems by adopting a container made from a flexible plastic material, either as an isolated piece, or as a piece in series with other pieces, provided with a threaded neck having an axial, cylindrical tubular extension with a transverse membrane-diaphragm, and upstream of said extension an outlet mouth having a divergent cone-frustum shape. The outlet bore of said extension is calibrated, and has a diameter larger than the minimum diameter of said outlet mouth. On the outer surface of the said extension a circumferential groove is provided. The capsule for sealing, piercing, and subsequently closing the container, is provided with an outer operation tab, and has on its inner wall a first threaded length for permitting it to be coupled with the thread provided the on container neck at the end of the threaded length, towards the inside of the capsule a restraint ring protrudes, which is destined to become engaged in a springwise fashion inside said groove in order to guarantee sealing. From the bottom of the same capsule a piercing element protrudes in the axial direction, which is suitable for piercing said membrane and causing the edges thereof to adhere to the inner surface of the bore of said cylindrical neck extension, so is to equalize the inner diameter of the bore to the minimum diameter of the cone-frustum shaped outlet mouth. Due to the effect of screwing down of the capsule onto the neck, the restraint ring deforms and leaves the related groove, to follow the forward motion of the capsule.

The advantages of the present invention include a warranty seal, obtained by means of the transversal diaphragm and the coupling of the restraint ring of the capsule with the groove provided in the neck extension; the initial delivery of the liquid by piercing the diaphragm by the piercing element provided inside the capsule; metering the drops due to the effect of providing the flare downstream of the diaphragm with the adhesion of the edges of the diaphragm to the inner surface of the outlet bore provided in the extension of the container neck; possible re-use of the container; in case of a multi-dose container, with the hygienic reapplying of the capsule to the neck of the same container; operation simpleness; and low cost.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
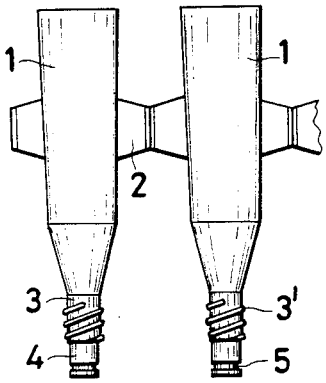
FIG. 1 shows a front view of a series or array of multi-dose containers of plastic material, each provided with a neck having a provided threaded end provided and a neck extension provided for the purpose of obtaining a controlled outlet mouth.
Figure 2:
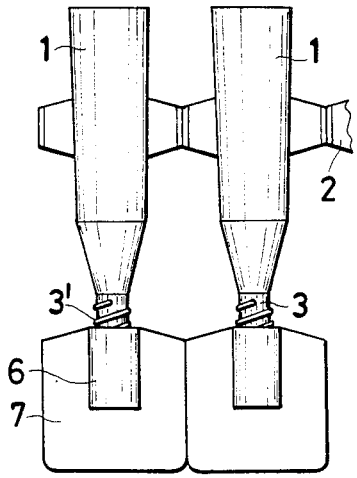
FIG. 2 shows a front view of FIG. 1, with said ends being each inserted in a sealing, piercing and closure capsule.
Figure 3:
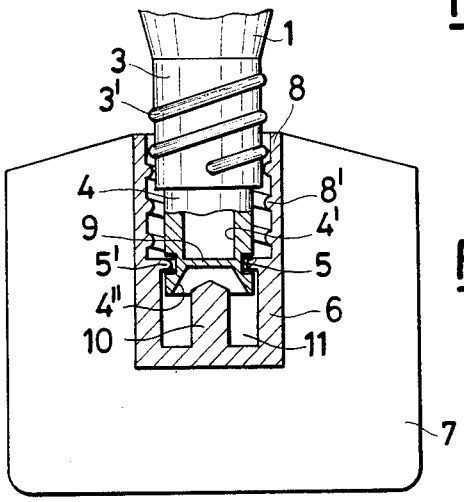
FIG. 3 shows an axial, sectional scrap view of the coupling region of the container outlet portion with said capsule being provided with a piercing element.
Figure 4:
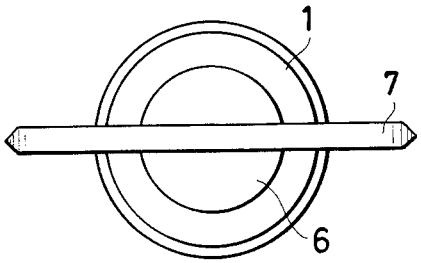
FIG. 4 is a bottom view of FIG. 3.

Element 1 represents the body of a container of plastic material, provided with tabs 2 for interconnection with other containers, to be actuated by tearing Element 3 is a cylindrical portion of the neck of container 1, provided with a fast-screwing thread Element 4 is a cylindrical tubular extension of said neck, of reduced diameter, provided with a calibrated bore 4' said bore having a diameter slightly larger than the minimum diameter of the outlet mouth 4'' and flared to a divergent cone frustum shape, to calibrate the drop. Element 5 is a circumferential restraint groove provided on the outer surface of the extension 4 and destined to engage, in a springlike fashion the restraint ring 5' (FIG. 3). The cylindrical capsule 6 is incorporated in the tab 7 for tearable connection with the tabs of adjacent capsules. Element 8 is provided at the entrance end portion of capsule 6, and is internally provided with threads 8', for coupling with the threads 3' of neck 3 of container 1. Element 9 is a membrane acting as a transversal diaphragm for the closure of container 1. The diaphragm is situated inside the exntension 4 as a separation element between the calibrated bore 4' and the outlet mouth 4'' said membrane being integral with said extension. Element 10 is a piercing pin, which protrudes centrally from the bottom of chamber 11 of capsule 6 for entering the outlet mouth 4'' of the extension 4, on the outer side relatively to membrane 9.

The operation is as follows: during the manufacturing step, the capsule 6 is applied to the neck of the container 1 until ring 5' is made springlike by entering the corresponding groove 5 of the extension 4. In such a position, the threads 3' on neck 3 engage the threads 8' of capsule 6. Thus, the container 1 is ready for transportation, and for being filled, with the subsequent welding of the opposite end edge being initially open. The cone-frustum flare 4'' of the outlet mouth allows the drop to be formed with precision and constancy. Thus, the drops are calibrated.

At the time of use, the user, after tearing the tabs 2 and 7 to separate container 1 and capsule 6 from adjacent containers and capsules, rotates the container and capsule relative to each other by gripping with one hands the tab 7 and capsule 6 and with the other hands the container Thus this causes the container to be screwed down on the thread 3' of neck 3 and, as a consequence, the piercing pin 10 moves towards the membrane 9, which is eventually pierced and adheres to the inner surface of bore 4'. Thus, the end diameter of said bore is equal to the inlet diameter of the outlet mouth 4''. During this operation, the restraining ring 5' is deformed to remove it from the related groove 5. After unscrewing the capsule 6 by acting on tab 7, the user can use the vial liquid contents, which flows down as calibrated drops from bore 4'-4'', by squeezing container 1. The capsule 6 can be then screwed down again for the purpose of tightly sealing the container, thanks to the coupling of the ring end of outlet mouth 4'' against the bottom of chamber 11.

As a practical embodiment, the materials, the dimensions, the structural details may be different from, but equivalent to, those as shown, without however going out of the juridical domain of the present invention.

Thus, the container 1, besides being a multi-dose container, can be as well a single-dose container, i.e., the contents can be exhausted in only one operation.

What is claimed is:

1. A container provided for the controlled dispensing of powders and liquids which comprises, a container body, an externally threaded neck provided on said container body, a cylindrical, tubular extension member axially connected at one end to the externally threaded container neck, said cylindrical, tubular extension member having an inner bore comprising a calibrated protion and terminating at the other end thereof in a divergent frustoconical outlet mouth portion, a rupturable transverse membrane diaphragm sealingly separating the calibrated portion from the outlet mouth portion, a circumferential groove provided on the outer surface of said tubular extension member, in the vinicity of the diaphragm, and a cylindrical capsule acting as a sealing and resealing device, said capsule having at one end thereof an internally threaded portion adapted for screw engagement with the externally threaded neck, an elastic retraining ring circumferentially provided on the inner surface of the cylindrical capsule for spring-engagement with said circumferential groove, and a piercing pin extending axially within said cylindrical capsule, said piercing pin piercing the diaphragm when the cylindrical capsule is screwed down onto said neck causing the restraining ring to exit the circumferential groove of the tubular extension member, wherein the calibrated portion of the inner bore of said tubular extension has a diameter larger than the minimum diameter of the divergent frustum conically shaped outlet mouth portion and as such becomes equal to said minimum diameter by the overlapping of the diaphragm edges generated by the piercing action of the piercing pin of the cylindrical capsule, whereby when the restraining ring is engaged in said circumferential groove, the axial movement of the cylindrical capsule relative to the externally threaded neck is prevented.

2. The container of claim 1 wherein said container is made of a plastic material.

3. The container of claim 1 wherein a plurality of said containers are interconnected in series by tab members.

* * * * *